US006998370B2

(12) United States Patent
Juang et al.

(10) Patent No.: US 6,998,370 B2
(45) Date of Patent: Feb. 14, 2006

(54) WASHING AGENT FOR REMOVING RESIDUAL PESTICIDE OF VEGETABLES

(76) Inventors: Guo-Ping Juang, Board of Health in Yuanzhou Area, Yichun City, Jiangxi Provice (CN); Yu-Gui Zou, Board of Heath in Yuanzhou Area, Yichun City, Jiangxi Provice (CN)

( * ) Notice: Subject to any disclaimer, the term of this patent is extended or adjusted under 35 U.S.C. 154(b) by 249 days.

(21) Appl. No.: 10/435,492

(22) Filed: May 8, 2003

(65) Prior Publication Data

US 2004/0220061 A1 Nov. 4, 2004

(30) Foreign Application Priority Data

May 8, 2002 (CN) ..... 01135921 A

(51) Int. Cl.
*C11D 3/33* (2006.01)
*C11D 3/10* (2006.01)

(52) U.S. Cl. ..... 510/111; 510/509; 510/499

(58) Field of Classification Search ..... 510/111, 510/499, 509

See application file for complete search history.

(56) References Cited

U.S. PATENT DOCUMENTS 3,910,296 A * 10/1975 Karageozian et al. ..... 134/2
4,670,178 A * 6/1987 Huth et al. ..... 422/28
5,494,817 A * 2/1996 Chen ..... 435/188
6,500,476 B1 * 12/2002 Martin et al. ..... 426/262

* cited by examiner

*Primary Examiner*—Charles Boyer
(74) *Attorney, Agent, or Firm*—Raymond Y. Chan; David and Raymond

(57) ABSTRACT

The present invention is to provide a washing agent for removing a pesticide in a vegetable consisting a predetermined composition prepared by a preparation process, wherein said preparation process comprises the steps of a) providing a first solvent which is a basic metal carbonate or bicarbonate solvent and a second solvent which is a cysteine solution, b) mixing the first solvent and the second solvent to form a resulting washing solvent c) soaking a predetermined vegetable in the resulting washing solvent for 20 minutes; and d) washing the vegetable with water such that a residual pesticide of the vegetable is removed wherein the production of the washing agent is simple, low cost, and non-hazardous to health which is an ideal washing agent for use.

1 Claim, No Drawings

WASHING AGENT FOR REMOVING RESIDUAL PESTICIDE OF VEGETABLES

BACKGROUND OF THE PRESENT INVENTION

1. Field of Invention

The present invention relates to a washing agent for vegetable, and more particularly to a washing agent which is capable of washing away any residual pesticide, fungicide, insecticide and the like in editable plants such as vegetables and fruits.

2. Description of Related Arts

Pesticides including fungicide and insecticide have been widely used in different kinds of edible crops and plants, commonly named as vegetables, including cucumbers, fruits, vegetables, and the like in agricultural for sale in the market. Intoxication of human beings due to consumption of vegetables having a high concentration of pesticide level have been happened frequently and it is an important issue to find a solution for reducing the pesticide level of vegetables. A Chinese patent of application number 97118313.9 entitled 'Washing solution of residual pesticide in vegetables' disclosed a solution used to wash away any residual pesticide in vegetables, wherein the washing solution consists of a composition of the major active components including sodium polyoxyethylene fatty (aliphatic) alcohol, sodium alkyl benzene sulfonate, sodium oxide, sodium carbonate, ethanol, glycerol (propane triol), and pure water. However, since the composition of the washing solution consists of sodium alkyl benzene sulfonate, sodium polyoxyethylene fatty alcohol and propane triol, vegetables may easily be exposed to a second contamination by these chemicals through adsorption and hence the use of this washing solution may impose hazardous health effect to human. Moreover, the washing solution consists of a lot of chemical components that will dramatically increase the production cost, induce a prolonged production time, make it very inconvenience during production and use, and thus make it difficult to put it into the market for sale.

SUMMARY OF THE PRESENT INVENTION

A main object of the present invention is to provide a washing agent for removing a pesticide in a vegetable which has the properties of not having a second contamination to the vegetables, not posing health hazards to human, consisting a minimum chemical composition, having a low production cost, and easy and convenience to produce and use.

Accordingly, in order to accomplish the above objects, the present invention is to provide a washing agent for removing a pesticide in a vegetable consisting a predetermined composition prepared by a preparation process, wherein the preparation process comprises the steps of a) providing a first solvent selecting from the group of a 0.5–1.0% basic metal carbonate and a 0.5–1.0% basic metal hydrogen carbonate;

b) providing a second solvent which is a 0.1–0.3% cysteine solution; and c) mixing the first solvent and the second solvent to form a resulting solvent wherein a mixing ratio of the first solvent and the second solvent is 5–10 to 1–2.

These and other objectives, features, and advantages of the present invention will become apparent from the following detailed description, the accompanying drawings, and the appended claims.

DETAILED DESCRIPTION OF THE PREFERRED EMBODIMENT

The present invention is to provide a washing agent for removing a pesticide in a vegetable consisting a predetermined composition prepared by a preparation process, wherein the preparation process comprises the steps of a) providing a first solvent selecting from the group of a 0.5–1.0% basic metal carbonate and a 0.5–1.0% basic metal hydrogen carbonate;

b) providing a second solvent which is a 0.1–0.3% cysteine solution; and c) mixing the first solvent and the second solvent to form a resulting solvent wherein a mixing ratio of the first solvent and the second solvent is 5–10 to 1–2.

A first preferred embodiment of the present invention is prepared by a preparation process comprising the steps of a') providing a first solvent selecting from the group of a 0.5–1.0% basic metal carbonate and a 0.5–1.0% basic metal hydrogen carbonate;

b') providing a second solvent which is a 0.1–0.3% cysteine solution; and c') mixing the first solvent and the second solvent to form a resulting washing solvent wherein a mixing ratio of the first solvent and the second solvent is 6 to 1.

According to the washing agent for removing a pesticide in a vegetable of the present invention, an application of the washing agent is an application process comprising the steps of Aa) preparing the resulting washing solvent having a predetermined amount according to the preparation process of the washing agent of the present invention wherein the predetermined amount is capable of meeting the need of a user;

Ab) soaking a vegetable in the resulting washing solvent for a predetermined soaking time; and Ac) washing the vegetable with water such that a residual pesticide of the vegetable is removed.

In the above application process, the soaking time is preferably about 20 minutes.

The composition of the washing agent of the present invention consists of an edible sodium carbonate or sodium bicarbonate, and cysteine that is a necessary amino acid of human body. Therefore, after washing the vegetable by the washing agent of the present invention, the vegetable will not be contaminated by the second time contamination and will not introduce new hazards to the human body. Besides, the production process is simple, the production cost is low and the application of the present invention is convenience.

A residual pesticide test, for testing a pesticide level in the vegetable, may be carried out to test the effect of the washing agent of the present invention. For example, after washing the vegetable with the washing agent of the present invention, the vegetable is used as testing sample. A 'speed pesticide card' which is monitored by the Food Hygiene Inspector of the Health department in China and is manufactured by Guangzhou Tian He Greenland Biochemical Research Center, is used for testing the testing sample. A result shows that no indication of any residual pesticide is found in the testing sample and the result is very satisfactory.

The present invention is further illustrated by the following examples. In the preparation process of the present invention, the first solvent used is generally highly water soluble carbonate or bicarbonate such as potassium carbonate, potassium bicarbonate, sodium carbonate and aluminum carbonate because only highly water soluble solution is capable of producing an effective resulting washing solution.

EXAMPLE ONE

A first example of the first preferred embodiment of the present invention is prepared by a first preparation process comprising the steps of 1a) providing a first solvent which is a 1.0% sodium carbonate and a second solvent which is a 0.1% cysteine solution;

1b) mixing the first solvent and the second solvent to form a resulting washing solvent wherein a mixing ratio of the first solvent and the second solvent is 5 to 1;

1c) soaking a predetermined vegetable in the resulting washing solvent for a predetermined soaking time wherein the soaking time is 20 minutes; and 1d) washing the vegetable with water such that a residual pesticide of the vegetable is removed wherein the vegetable is defined as a first testing vegetable sample.

EXAMPLE TWO

A second example of the first preferred embodiment of the present invention is prepared by a second preparation process comprising the steps of 2a) providing a first solvent which is a 0.6% potassium carbonate and a second solvent which is a 0.15% cysteine solution;

2b) mixing the first solvent and the second solvent to form a resulting washing solvent wherein a mixing ratio of the first solvent and the second solvent is 8 to 1;

2c) soaking a predetermined vegetable in the resulting washing solvent for a predetermined soaking time wherein the soaking time is 15 minutes; and 2d) washing the vegetable with water such that a residual pesticide of the vegetable is removed wherein the vegetable is defined as a second testing vegetable sample.

A residual pesticide test, for testing a pesticide level in the vegetable, is then carried out to test the effect of the washing agent of the present invention in the above example one and two. A 'speed pesticide card' that is monitored by the Food Hygiene Inspector of the Health department in China and is manufactured by Guangzhou Tian He Greenland Biochemical Research Center, is used for testing the first and the second testing vegetable samples. Results from the residual pesticide test show that no indication of any residual pesticide is found in the samples and the results are very satisfactory.

A process of carrying out the residual pesticide test by using the 'speed pesticide card' comprises the steps of Ta) applying 3 to 4 drops of water on a tip portion of a vegetable sample A;

Tb) grinding a tip portion of a vegetable sample B with a predetermined light force on the tip portion of the vegetable sample A with the water thereon to form a water sample;

Tc) dropping a drop of water sample onto an active portion of the speed pesticide card wherein the active portion of the speed pesticide card is white in color and waiting for 10 minutes;

Td) folding the speed pesticide card into half inwardly and grapping the speed pesticide card for 3 minutes; and Te) unfolding the speed pesticide card to obtain a card testing result.

A satisfactory result is indicated by the card testing result that shows the active portion of the speed pesticide card changes into blue in color. A result indicating that the water sample contains excess organic phosphate pesticide level is shown by the unchanged color of the active portion of the speed pesticide card or by the change of color from white to pale blue of the active portion of the speed pesticide. A control test is suggested to be carried out by the above processes which use purified water as water sample for the speed pesticide card test.

One skilled in the art will understand that the embodiment of the present invention described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A washing agent for removing a pesticide in a vegetable consisting of a predetermined composition prepared by a preparation process, wherein said preparation process comprises the steps of a) providing a first solvent selected from the group consisting of a 0.5% to 1.0% basic metal carbonate solution and a 0.5% to 1.0% basic metal hydrogen carbonate;

b) providing a second solvent which is a cysteine solution having a concentration between 0.1% and 0.3%; and c) providing a predetermined mixing ratio of said first solvent and said second solvent in the form A to B and mixing said first solvent and said second solvent to form a resulting solvent wherein A is in the range between 5 and 10 and B is in the range between 1 and 2, wherein said mixing ratio of said first solvent and said second solvent is 6 to 1.

* * * * *